US005351514A

United States Patent [19]

Recio

[11] Patent Number: 5,351,514

[45] Date of Patent: Oct. 4, 1994

[54] LOCKING MECHANISM

[76] Inventor: Alberto R. Recio, Islas Cíes, 59-8oM 28035, Madrid, Spain, 28035

[21] Appl. No.: 991,255

[22] Filed: Dec. 16, 1992

[30] Foreign Application Priority Data

Dec. 18, 1991 [ES] Spain ..... 9102807

[51] Int. Cl.[5] ..... E05B 27/08

[52] U.S. Cl. ..... 70/491; 70/387; 70/403; 70/409

[58] Field of Search ..... 70/288, 289, 355, 366, 70/387, 490, 491, 403, 404, 407, 409, 411

[56] References Cited

U.S. PATENT DOCUMENTS

| | | | |
|---|---|---|---|
| 1,067,017 | 7/1913 | Frederiksen | 70/490 |
| 1,154,499 | 9/1915 | Fischer | 70/490 X |
| 1,589,256 | 6/1926 | Spruth | 70/407 X |
| 2,098,249 | 11/1937 | Kistner | 70/403 X |
| 3,945,229 | 3/1976 | Frank | 70/491 |
| 4,424,692 | 1/1984 | Rousseau | 70/491 |
| 4,541,260 | 9/1985 | Rubinstein et al. | 70/288 X |
| 4,934,164 | 6/1990 | Shew | 70/409 X |
| 4,996,856 | 3/1991 | Lin et al. | 70/491 X |

FOREIGN PATENT DOCUMENTS

| | | | |
|---|---|---|---|
| 2806072 | 8/1979 | Fed. Rep. of Germany | 70/491 |
| 494000 | 3/1954 | Italy | 70/387 |
| 2170552 | 8/1986 | United Kingdom | 70/387 |

*Primary Examiner*—Peter M. Cuomo
*Assistant Examiner*—Suzanne L. Dino
*Attorney, Agent, or Firm*—Mason, Fenwick & Lawrence

[57] ABSTRACT

A locking mechanism is provided which is characterized by one or more blocking elements each consisting of two complementary semi-cylindrical parts (2),(3) snugly located in a correspondingly shaped aperture (4) defined between two relatively movable parts (5),(6) to be locked together, one of the semi-cylindrical parts (2),(3) being adapted to be operatively coupled to a key (8) to permit rotation of the two complementary semi-cylindrical parts (2),(3), whereby the two semi-cylindrical parts (2),(3) can be rotated between a position in which they prevent movement of the two lock parts (5),(6) and a position in which the two lock parts (5),(6) are relatively movable.

10 Claims, 9 Drawing Sheets

LOCKING MECHANISM

BACKGROUND OF THE INVENTION

The invention relates to a locking mechanism.

Systems used to date for the construction of slots of locks, padlocks, etc., are based essentially on the placing, longitudinally or transversally to the axis of the slot, of a set number of mobile elements, which together consist of little pivots pushed by springs, which move between one fixed part integral with the lock and the other mobile in respect to it; thus in a set position of the said mobile elements, obtained by displacing the same, the assembly of the two parts previously mentioned is unblocked, the latter remaining by contrast blocked with respect to each other in any other position of the former parts.

In the above-mentioned conventional systems, the displacement of the mobile elements referred to, in order to achieve unblocking, is obtained as a consequence of the adjustment of the said elements by appropriate projections of the corresponding key, whether by length of attack, height of serrations, or depth of drill holes, but in such a way that the displacement is always equal to that produced by the notches of the key according to the height or depth with which they are formed.

SUMMARY OF THE INVENTION

In accordance with the subject of the invention a system is proposed which differs from this conventional concept in that with this system some more advantageous characteristics are achieved than those of the above-mentioned conventional systems.

According to the invention there is provided a locking mechanism, characterised by one or more blocking elements each consisting of two complementary semi-cylindrical parts snugly located in a correspondingly shaped aperture defined between two relatively movable parts to be locked together, one of the semi-cylindrical parts being adapted to be operatively coupled to a key to permit rotation of the two complementary semi-cylindrical parts, whereby the two semi-cylindrical parts can be rotated between a position in which they prevent movement of the two lock parts and a position in which the two lock parts are relatively movable. Preferably the one semi-cylindrical part is operatively coupled to the key by means of a rotatable member, more preferably a cylindrical rod.

The system forming the subject of the invention is based on the rotating mobility of a cylinder by the action of the longitudinal displacement of an operating part, due to the sliding of a projection of the operating part through a helical groove in the cylinder in such a way that with the consequent rotation of some complementary semi-cylindrical parts located in a corresponding aperture defined between respective concentric bodies, blocking and unblocking of the said bodies with respect to each other is achieved, according to the rotational position of the above-mentioned semi-cylindrical parts.

In this way, if the blockable and unblockable concentric bodies are arranged in a fixed way with respect to the fixed and mobile parts of the lock, the blocking and unblocking of the latter is realisable by means of the simple introduction of the part operating on the cylinder, which thus serves the function of a key, allowing different combinations simply by varying the longitudinal position of its projections, since it is that which determines whether the rotation of the cylinder is accurate in order for the semi-cylindrical parts to remain in the position of unblocking the concentric bodies.

In this way a mechanical system is obtained which allows a large number of possible combinations of operating key and perfect security of blocking of the lock for the purpose for which it is applied, with the advantage that the locating or blocking parts are totally inaccessible from outside, and even though the cylinder may break, because they are not lined up, the slot will not be unblocked.

This system does not use springs, although the blocking elements can be positioned by simple guided sliding of the key over the rotating cylinder, the blocking position being regained by the very withdrawal of the key, thus avoiding those functional defects arising from the variability of springs, making the said proposed system also more secure.

Moreover, this new system also allows the facility for constructing slots with multiple blocking cylinders and even constructing associated multiple slots, which can be operated simultaneously by means of one single key, which would make it possible for the number of possible combinations to be practically limitless, with security at the same time, including the correct use of the key, given that, thanks to various different ways of introducing the key, of which only one is effective, this means that only the proprietor can use it correctly.

For all of the above reasons, the system forming the subject of the invention certainly has some very advantageous characteristics, which give it individuality and preferential character over the conventional systems which are being used for the same purpose of blocking slots of similar locks.

BRIEF DESCRIPTION OF THE DRAWINGS

The invention is diagramatically illustrated, by way of example, in the accompanying drawings in which.

EXPLANATORY DETAILS

Figure 1:
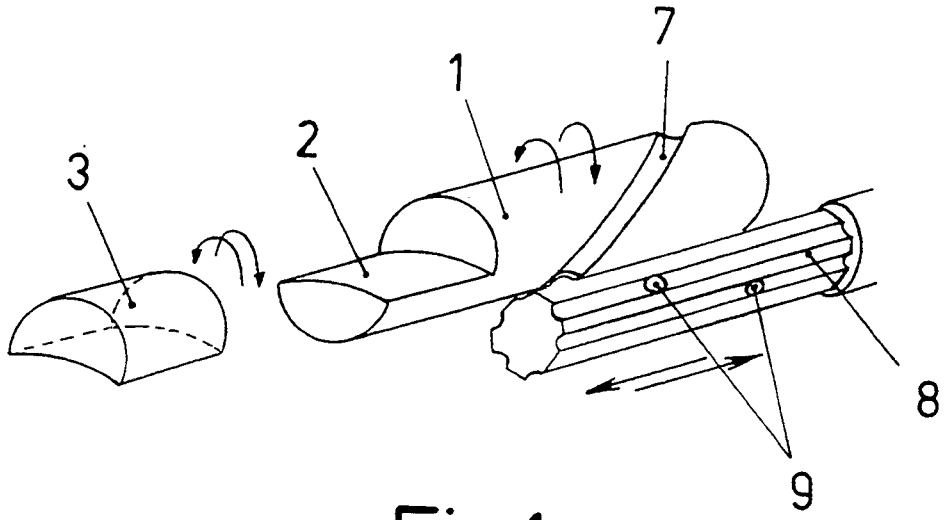
FIG. 1 is a schematic diagram in perspective of the rotating action of a cylinder by means of the longitudinal displacement of an operating key, in accordance with the system formings the subject of the invention.
Figure 2:
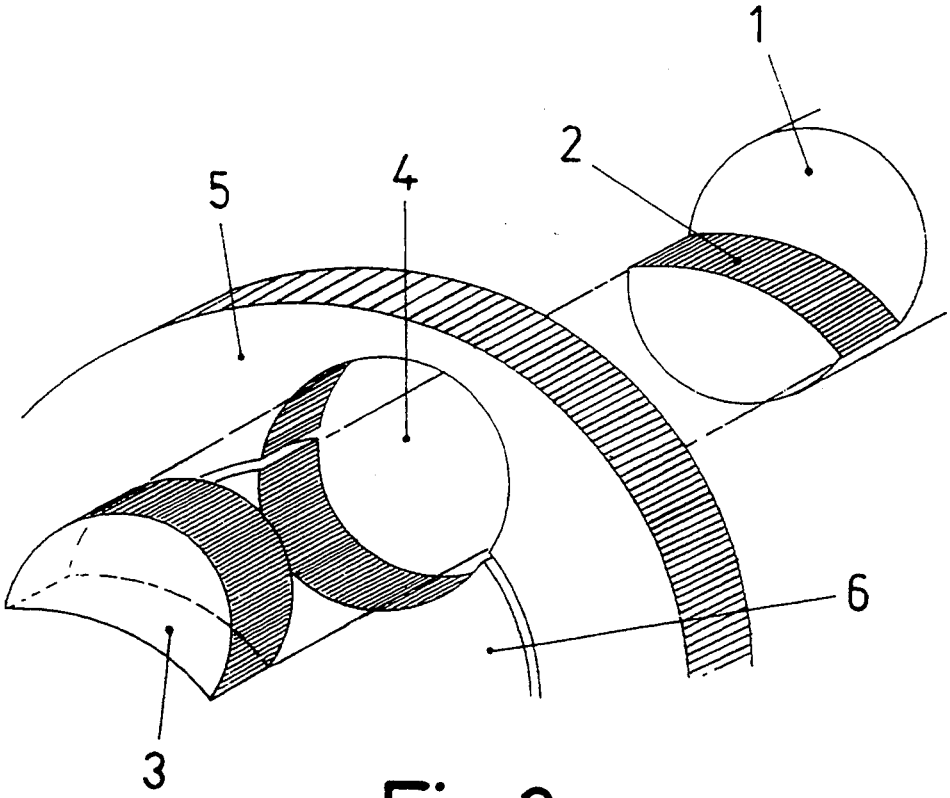
FIG. 2 is an exploded diagram of the housing of the rotating cylinder and the complementary semi-cylindrical part in respect to the two concentric bodies between which blocking is brought about.

1. - Cylinder
2. - Semi-cylindrical blocking part
3. - Complementary semi-cylindrical part
4. - Aperture
5. - External concentric body
6. - Internal concentric body
7. - Helical groove
8. - Operating key
9. - Projection
10. - Interchangeable parts
11. - Guide accessories

DETAILED DESCRIPTION OF THE PREFERRED EMBODIMENTS

The subject of the invention refers to a novel locking mechanism in which the elements for locking consist of a cylindrical rod (1), which has at its front end a semi-cylindrical structure (2), which is complemented by a corresponding independent semi-cylindrical part (3).

Figure 3:
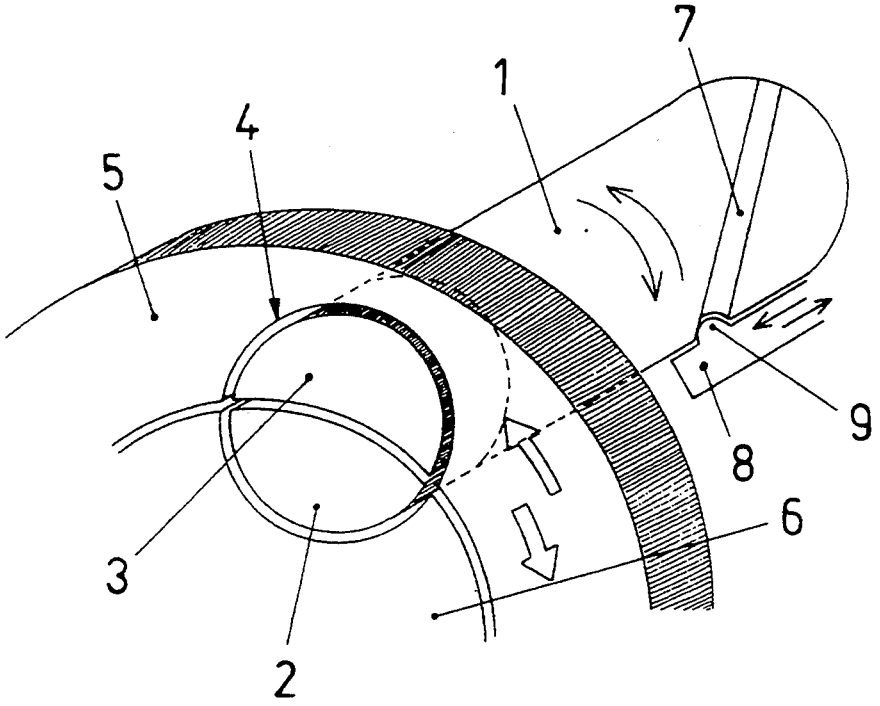
FIG. 3 shows details of the above-mentioned assembly of the rotating cylinder which can be operated by key and the concentric bodies which can be connected with the fixed and mobile parts of the lock, in the unblocked position between the above-mentioned concentric bodies.
Figure 4:
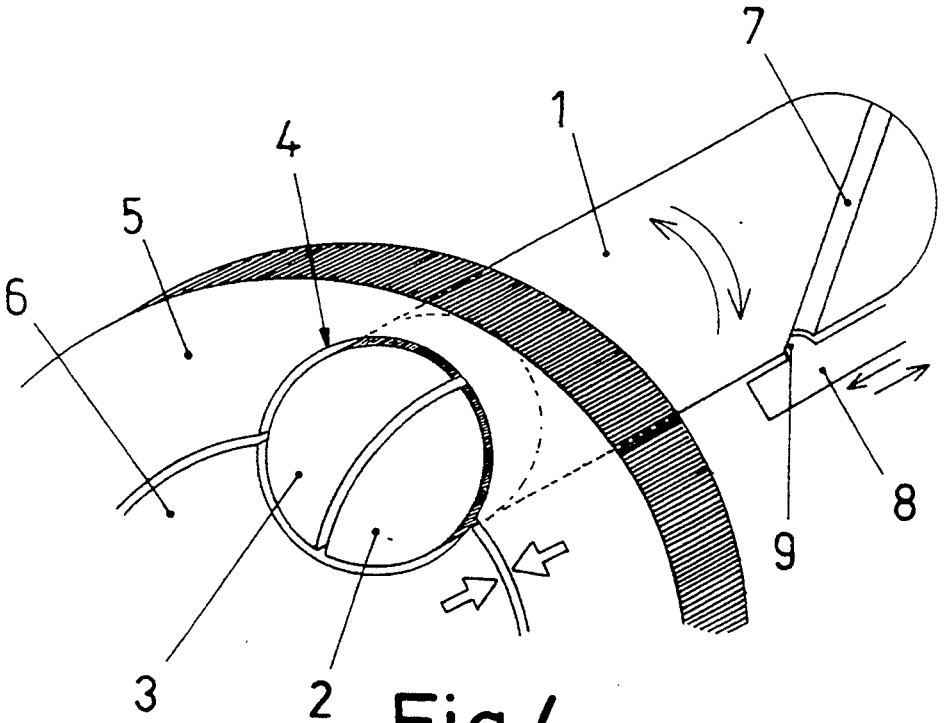
FIG. 4 shows details of the above-mentioned assembly of the rotating cylinder with the concentric bodies in the blocked position.
Figure 5:
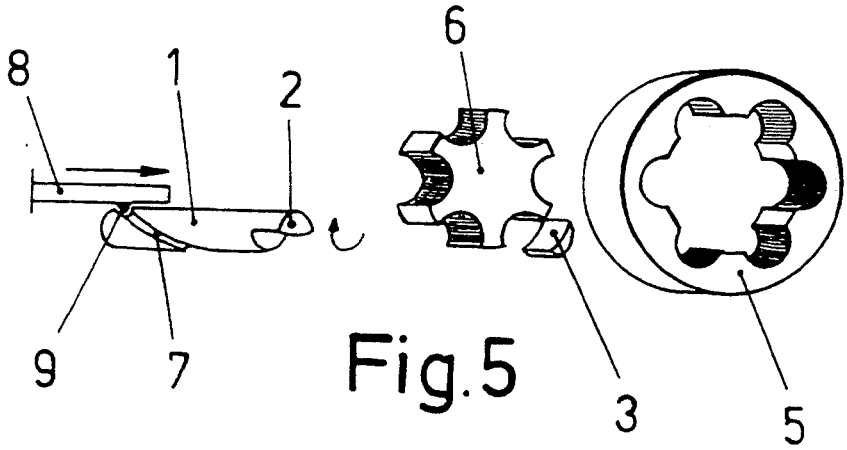
FIG. 5 is an exploded diagram in perspective of a slot assembly with six blocking cylinders, only one of the cylinders having been illustrated.

The said end of cylinder (1), formed by the assembly of semi-cylindrical parts (2) and (3), is enclosed in a respective corresponding aperture (4), defined between each of concentric bodies (5) and (6), which are respectively connected with the fixed and moving parts of the corresponding lock, in such a way that, according to what can be seen from FIGS. 3 and 4, when the assembly of semi-cylindrical parts (2) and (3) is arranged in such a way that its intermediate groove coincides with the division between bodies (5) and (6), rotation between the said bodies (5) and (6) and consequently operation of the lock becomes possible, whereas when this assembly of semi-cylindrical parts (2) and (3) are in any other rotating position, mobility between bodies (5) and (6) is blocked and operation of the lock is consequently blocked.

Cylinder (1) is provided to that effect with a helical groove (7) defined along the same, such that the corresponding key (8) for operation of the lock is provided, in the corresponding correlating area of coincidence with the above-mentioned cylinder (1), with a projection (9) which is capable of being fitted by sliding into the above-mentioned groove (7).

In this way, when key (8) is introduced into the slot, its own longitudinal displacement on introduction makes cylinder (1) rotate, with the effect that if the location of projection (9) over key (8) is sufficient for rotation of cylinder (1) to be effected precisely, which makes it locate itself at the assembly of semi-cylindrical parts (2) and (3) with their intermediate groove coinciding with the two bodies (5) and (6), the said introduction of key (8) brings about unblocking for the easy operation of the slot to which it is applied; so when the key itself (8) is withdrawn the positioning for the initial blocking occurs again.

With such a realisation and operation, the number of possibilities of variations of the state of cylinder (1) in each case becomes great, since according to the longitudinal position in which projection (9) on key (8) is found, the rotation which is achieved by means of the introduction of the latter is different, and this enables a large number of different combinations to be obtained, varying this positioning of projection (9) on key (8) and the angular location of the assembly of semi-cylindrical parts (2) and (3) with respect to groove (7) of cylinder (1), so that when key (8) is introduced it determines the position of unblocking of concentric bodies (5) and (6) with respect to each other.

Figure 6:
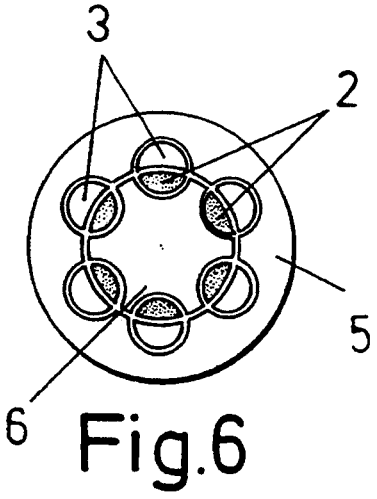
FIG. 6 represents the schematic cross-section of a slot with six cylinders, in the unblocked position of the rotating concentric bodies having the semi-cylindrical parts aligned with each other.
Figure 7:
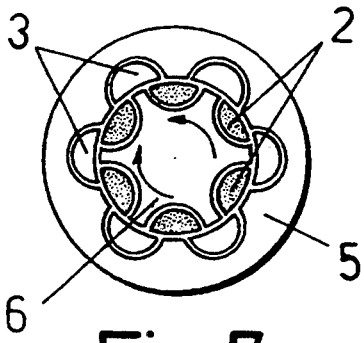
FIG. 7 represents the schematic cross-section of the slot with six cylinders, in the unblocked position of the rotating concentric bodies having the semi-cylindrical parts allow relative rotation between the concentric bodies.
Figure 8:
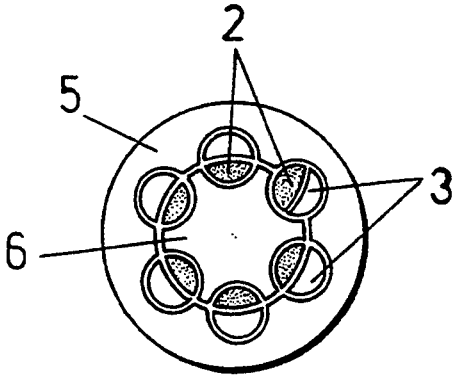
FIG. 8 represents the schematic cross-section of the slot with six cylinders in a position in which one of the sets of semi-cylindrical parts enclosed between the concentric bodies causes blocking between the same, respectively.
Figure 9:
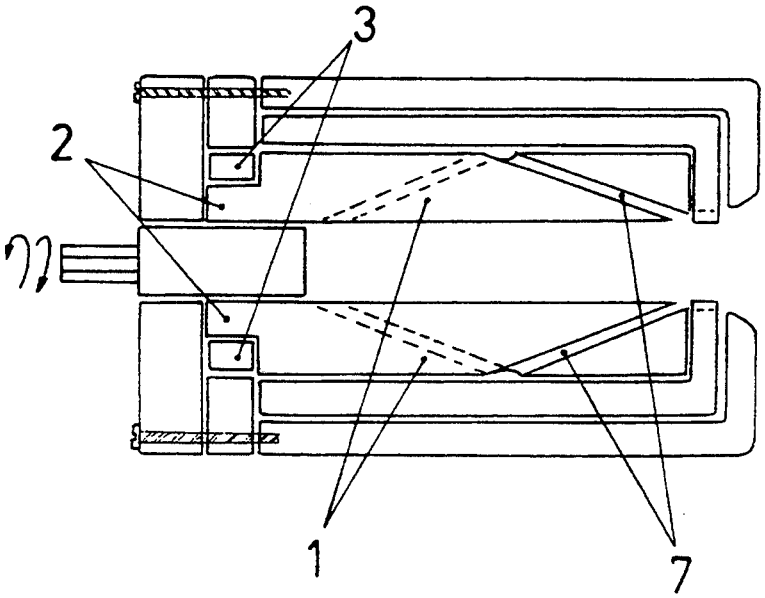
FIG. 9 corresponds to the schematic view of a longitudinal section of the above-mentioned slot with six cylinders.

Based on the said fundamental principal, the practical realisation of the assembly of a slot in accordance with this system can consist of two simple concentric bodies (5) and (6) and the inclusion of a set of multiple cylinders (1) for blocking and unblocking with respect to each other, in conformity with the views in FIGS. 5 to 9, in such a way that the position of unblocking has to be accomplished with all the sets of semi-cylindrical parts (2) and (3) corresponding to the different cylinders (1), as can be seen in FIG. 6, so that rotation between concentric bodies (5) and (6) is achievable, as can be seen in FIG. 7; as long as any of the assemblies of parts (2) and (3) are not in the correct position, as can be seen in FIG. 8, blocking of bodies (5) and (6) with respect to each other will be established.

Figure 10:
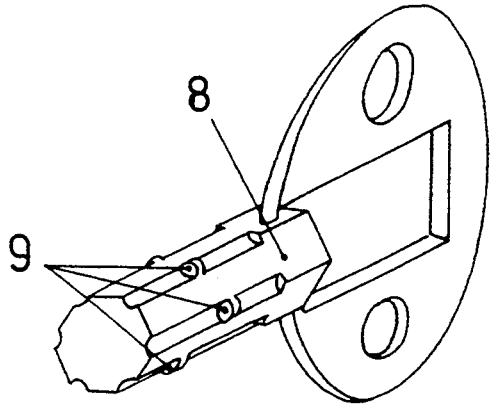
FIG. 10 is a perspective of the corresponding key for the said slot with six cylinders.

Under the said conditions it is clear that all the assemblies of parts (2) and (3) have to be operated simultaneously to bring about unblocking, and for this a key (8) is provided, as shown in FIG. 10, provided with as many projections (9) as the slot contains cylinders (1)

and situated adequately for each one of them to operate on one of the cylinders (1) of the slot, as well as positioned longitudinally in a precise way such that by means of them the respective cylinders (1) are positioned in the correct position for unblocking bodies (5) and (6) when the key is introduced into the slot.

This in turn brings about a possibility of practically limitless combinations of key (8), with the additional peculiarity that it is necessary to know the precise position of introduction of the latter for the rotating operation to be carried out, given that only one of the six possible positions of introduction is effective.

Figure 11:
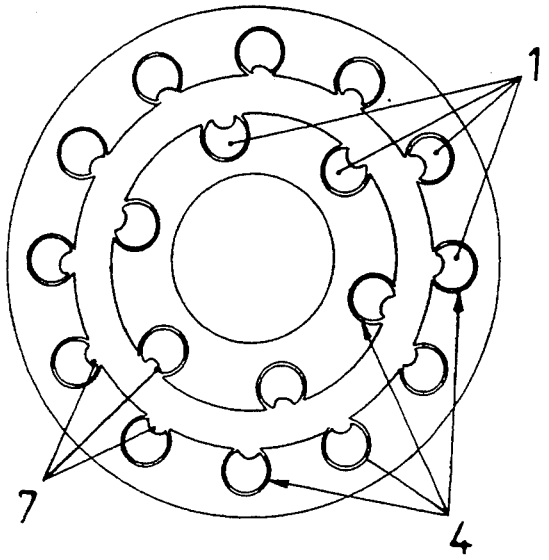
FIG. 11 is a schematic frontal view of a slot fitted with an assembly of eighteen cylinders divided into two groups of six and twelve respectively.
Figure 12:
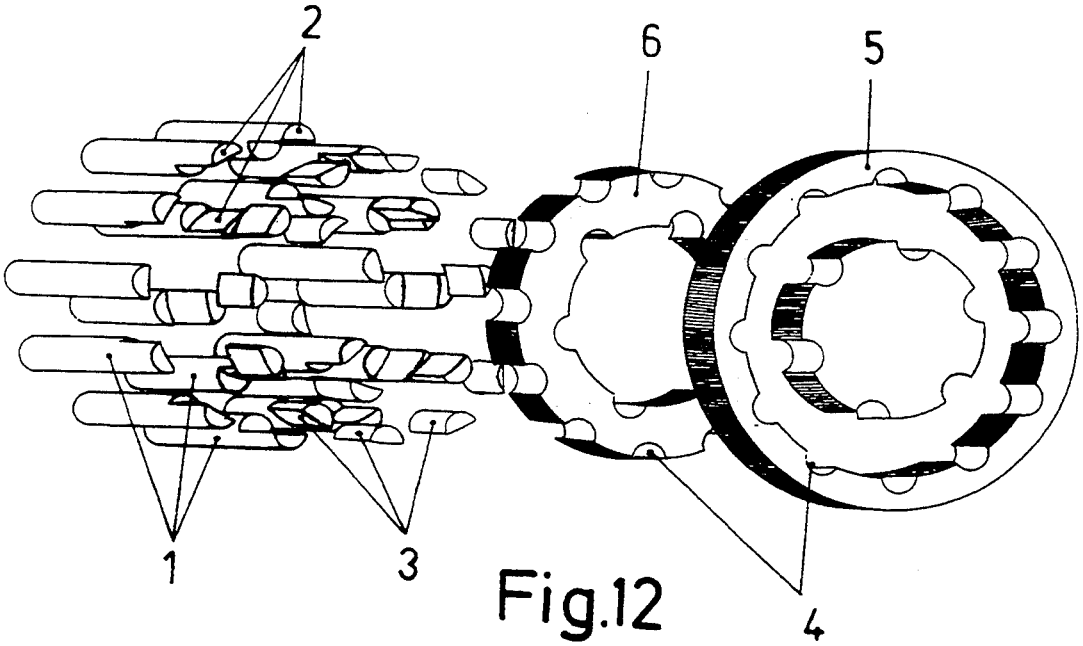
FIG. 12 is an exploded diagram in perspective of the said slot with eighteen cylinders.
Figure 13:
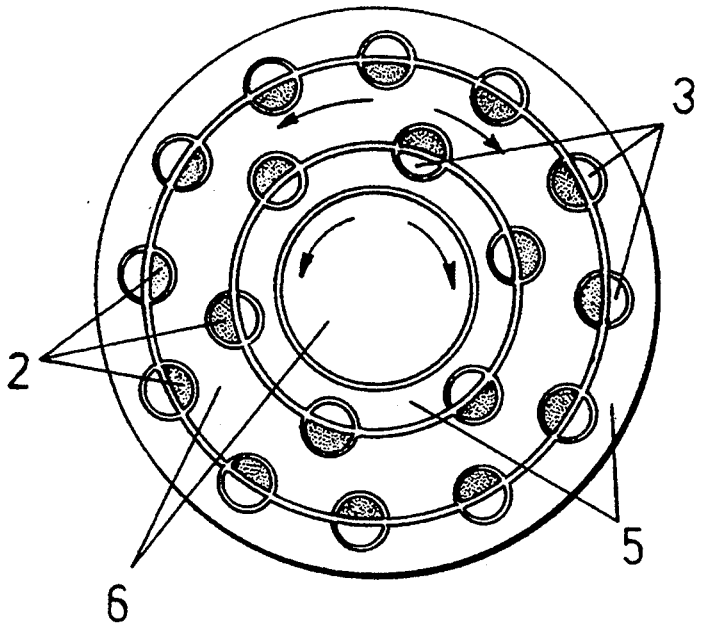
FIG. 13 is the view of a transverse section of the said slot with eighteen cylinders, showing the area of blocking and unblocking of the respective concentric bodies.

Underlying this aspect of multiple combinations which confer a greater level of security, the realisation of the slot can be carried out with a larger number of cylinders (1), such as for example with a total set of 18 cylinders (1) distributed in two concentric groups of 6 and 12 respectively, as shown in FIGS. 11 to 13, in which case logically a tubular key (8) would be required with interior and exterior projections (9) to operate on all the cylinders (1).

Figure 14:
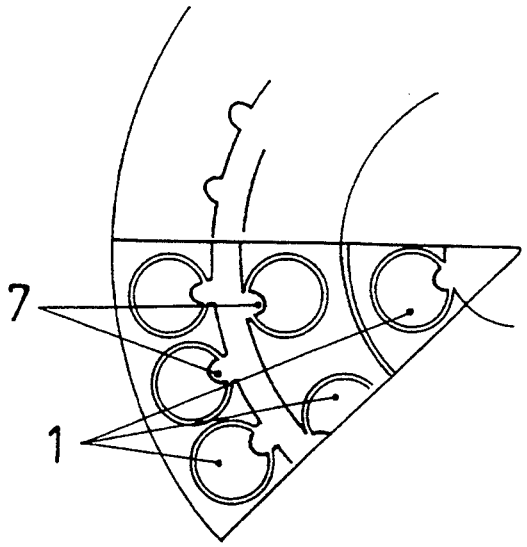
FIG. 14 is a detail corresponding to a partial frontal schematic diagram of a slot with forty-two cylinders divided into three groups of six, twelve and twenty-four respectively.
Figure 15:
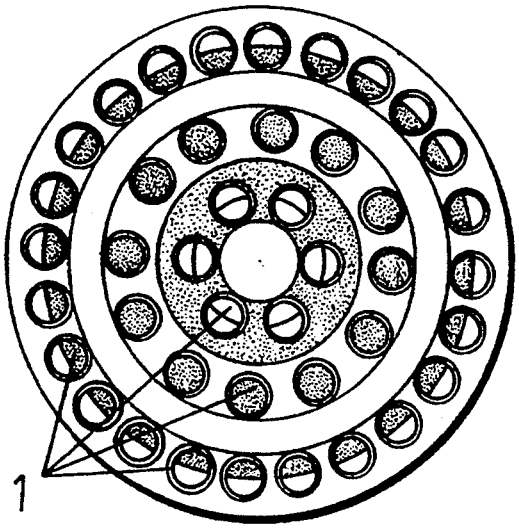
FIG. 15 is the view of a transverse section of the said slot with forty-two cylinders, showing the area of blocking and unblocking of the respective concentric bodies.
Figure 16:
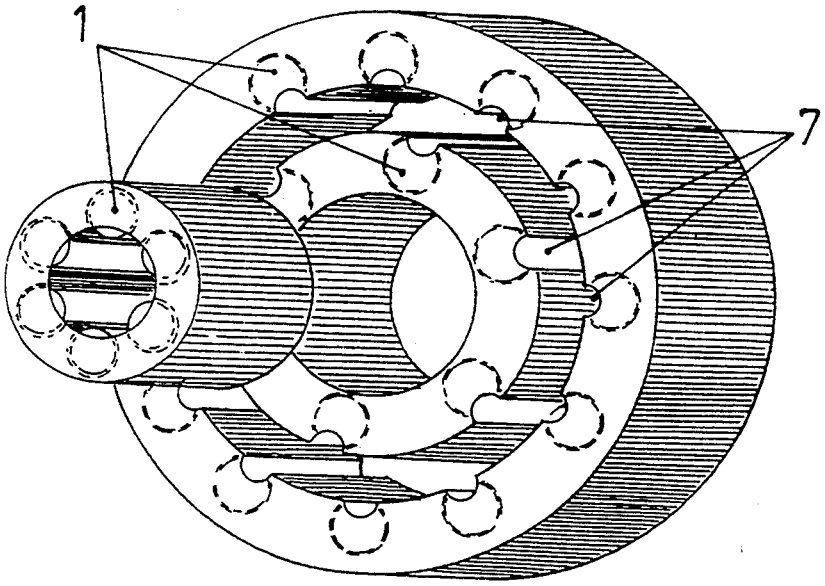
FIG. 16 is an exploded diagram in perspective of the concentric bodies of the said slot with forty-two cylinders.

Even more complexity can be included, based on multiple associated slots, such as for example an assembly with a central slot with six cylinders (1), forming an integral part of a larger slot with two concentric groups of twelve and twenty-four cylinders (1) respectively, such as is the case in FIGS. 14 to 16, in which case a total of forty-two blocking cylinders would result, with which clearly so complex a combination would be obtained that the security of inviolability would be practically total.

Figure 17:
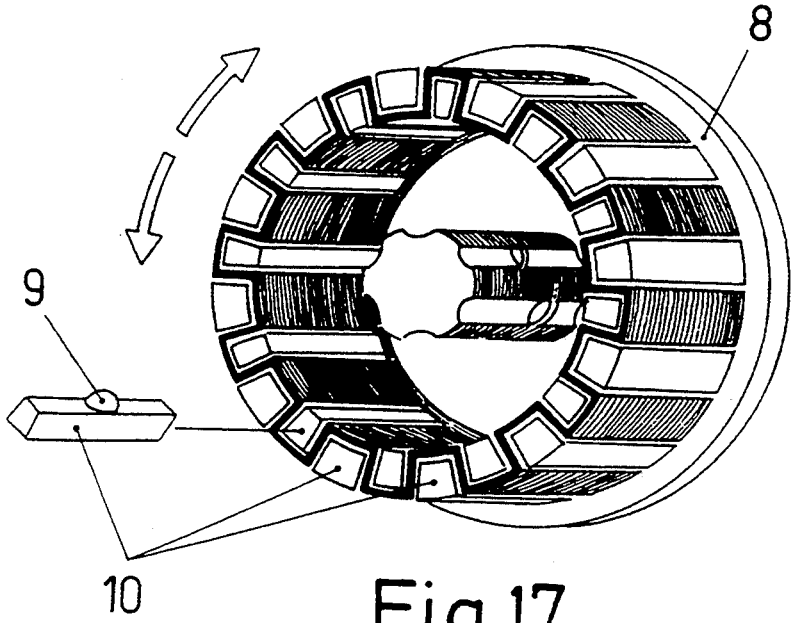
FIG. 17 is a perspective of a key for the above-mentioned slot with forty-two cylinders, provided with interchangeable elements.

In such a case the realisation of the corresponding key (8) would be as shown in FIG. 17, that is to say with a central nucleus and a tubular rim both provided with projections (9) on their surfaces to operate the different cylinders (1), the said key (8) being able to be realised with interchangeable parts (10) for better process of manufacture and to give the user great security in the case of loss of the same.

Figure 18:
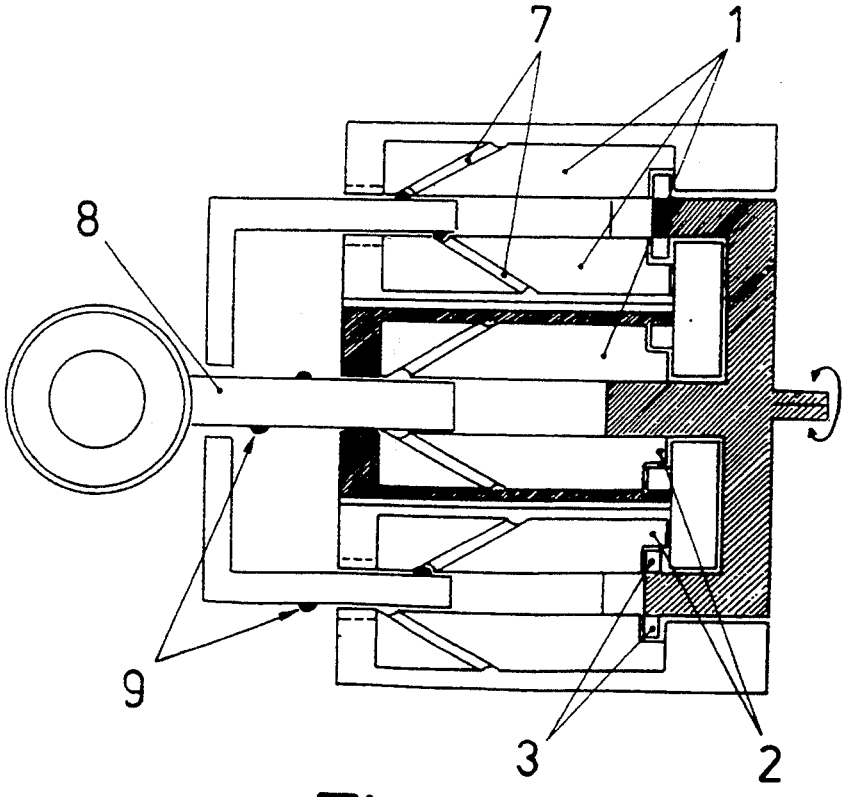
FIG. 18 is a view of the longitudinal section of the said slot with forty-two cylinders, with the corresponding key partially introduced.

Moreover, the said key (8) for such a complex combination would consist of two independent parts in such a way that, as can be seen in FIG. 18, the central nucleus of the same would be the operating part for the rotating operation and the external rim would only be to position the corresponding cylinders (1) for unblocking, both parts being able to rotate with respect to each other when the slot is operated; this in turn gives a total guarantee of security, even including using the key, given that its many ways of introduction and withdrawal mean that only the proprietor, knowing the appropriate position, can use it correctly.

In effect, in the case of the afore-mentioned slot with forty-two cylinders (1), the key (8) only operates rotation in one single position, but however its introduction can be carried out in seventy-two different positions (6) with respect to the central part and twelve with respect to the external rim); inasmuch as withdrawal can be carried out in six different positions (which correspond to the six positions of the central part), this gives such diverse possibilities that only that person who knows the effective position can use the key with efficacy.

In any case, the blocking parts formed by the assemblies of semi-cylindrical parts (2) and (3) are totally inaccessible from outside, and even if the corresponding cylinders (1) were broken, blocking of concentric bodies (5) and (6) with respect to each other would continue, without the lock being able to be operated.

The possibilities of realisation of slots with multiple cylinders (1) are however not limited to the examples described, since in the same way other different possibilities exist, as there could be, in addition to those already indicated, a slot with twelve cylinders (1) in one single circular group, a slot with twenty-four cylinders (1) also in one single circular group, a slot with thirty cylinders (1) distributed in two concentric groups of six and twenty-four respectively, a slot with thirty-six cylinders (1) distributed in two concentric groups of twelve and twenty-four respectively, as well as any other possible combination imaginable.

Figure 19:
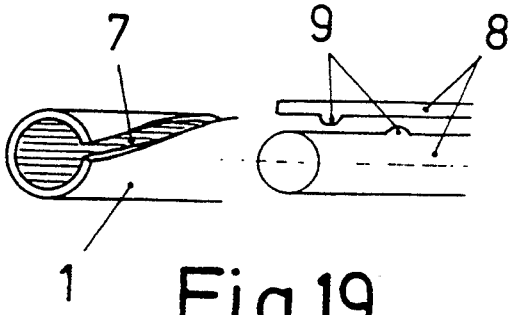
FIG. 19 shows one variation in practical realisation of the cylinders which can be operated by key according to the system forming the subject of the invention wherein each cylinder is hollow.
Figure 20:
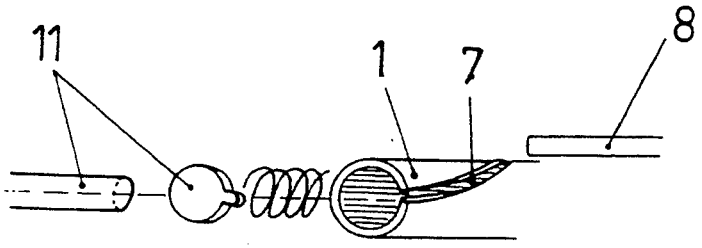
FIG. 20 shows another variation of the cylinders each being hollow and incorporating guide accessories.
Figure 21:
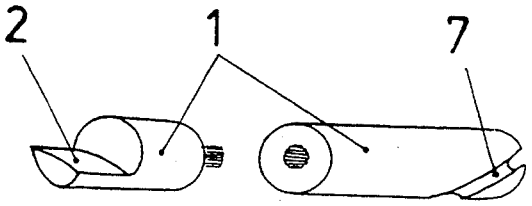
FIG. 21 shows a third variation of the cylinders each consisting of two complementary parts which can be connected together.

In another case, the cylinders (1) to realise this system could be formed by one single part, the corresponding semi-cylindrical structure (2) for blocking being formed at its end, or consist of two complementary parts which can be connected together such as is shown in FIG. 21; the said cylinders (1) can also be hollow, as shown in FIGS. 19 and 20, the corresponding key (8), being able in another case to include the internal and/or external parts for operating on the said cylinders (1), and be included in combination With complementary guide accessories (11).

The invention thus provides a simple but effective locking mechanism.

I claim:

1. A locking mechanism having a fixed lock part, a movable lock part rotatably engaged with the fixed lock part and one or more blocking elements for preventing relative rotation between the fixed and movable lock parts, the blocking element being snugly and axially rotatably engaged in a cylindrical cavity defined partly in the fixed lock part and partly in the rotatable lock part, the improvement comprising:

means for preventing axial displacement of the blocking element including the blocking element consisting of first and second complementary semi-cylindrical parts, and the first semi-cylindrical part being adapted to be operatively coupled to a key to effect rotation of the first and second complementary semi-cylindrical parts, whereby the first and second semi-cylindrical parts can be rotated between a blocking position in which they prevent relative movement between the fixed and movable lock parts and an unblocked position with the first and second semi-cylindrical parts engaged in the movable and fixed lock parts, respectively, in which the fixed and movable lock parts are relatively movable.

2. A locking mechanism according to claim 1, wherein the first semi-cylindrical part is operatively coupled to the key by means of a rotatable member.

3. A locking mechanism according to claim 2, wherein the rotatable member is a cylindrical rod.

4. A locking mechanism according to claim 2, wherein the rotatable member is formed with a longitudinally positioned helical groove, and the key is formed with a projection adapted to slide in said groove such that when the key is introduced the longitudinal displacement of the key results in rotation of the rotatable member.

5. A locking mechanism having one or more blocking elements, each blocking element comprising first and second complementary semi-cylindrical parts which are rotatably engaged in a corresponding cylindrical cavity defined between two concentric bodies respectively associable to the corresponding fixed and moving parts of the locking mechanism to which it is applied and each cylindrical cavity is formed so as to prevent axial displacement of the blocking element therein, the first semi-cylindrical part being integral with a cylindrical rod which can be operated by rotating by means of a corresponding key, in such a way that, as a function of the rotating position of the above-mentioned assembly of the first and second semi-cylindrical parts engaged in the concentric bodies, the concentric bodies are blocked or unblocked with respect to each other.

6. A locking mechanism according to claim 5, wherein the cylindrical rod to which the first and second semi-cylindrical parts of each blocking element are rotationally associated possesses longitudinally a helical groove, whilst the operating key possesses a projection which is able to fit slidingly into the said groove of the rod, in such a way that when the key is introduced, the longitudinal displacement of the same causes a consequent rotation of the rod.

7. A locking mechanism according to claim 6, wherein between the blockable concentric bodies, multiple blocking elements are incorporated each formed by respective assemblies of first and second semi-cylindrical parts, which can all be operated simultaneously by one single key provided with the necessary corresponding projections appropriately located over selected ones of the multiple blocking elements to operate on the different cylinders of the selected blocking elements.

8. A locking mechanism according to claim 7, wherein the blocking elements are distributed among a plurality of concentric groups between respective corresponding alternate parts of the concentric bodies to be blocked such that the multiple elements to be operated by the key are selectable from the among the plurality of concentric groups.

9. A locking mechanism according to claim 8, wherein the combination of two or more associated concentric slots are possible, for its combined operation by means of one single key provided with rotationally independent concentric parts, a multiple set of possibilities of introducing the key thus arising, amongst which only one is effective, as guarantee of security against outside manipulation even with the correct key.

10. A locking mechanism having a fixed lock part and a movable lock part rotatably engaged with the fixed lock part, said locking mechanism comprising:

a plurality of blocking elements each consisting of first and second complementary semi-cylindrical parts and slidably and rotatably engaged in a corresponding one of a plurality of cylindrical cavities defined between the fixed and movable lock parts so as to prevent relative rotation therebetween and thus to lock the fixed and movable lock parts together when said blocking element is rotated into a predetermined rotated position, each of the plurality of cylindrical cavities being further formed to prevent axial displacement of a corresponding blocking element therein; and a key having the first semi-cylindrical part of each of said plurality of blocking elements being operatively coupled thereto so as to be slidably engageable with the second semi-cylindrical part of a corresponding one of said plurality of blocking elements in the plurality of cylindrical cavities, said key being formed to rotate selected ones of the first and second complementary semi-cylindrical parts, whereby the first and second semi-cylindrical parts are rotated between a position in which the first and second semi-cylindrical parts prevent relative movement between the fixed and movable lock parts, and a position with the first and second semi-cylindrical parts engaged in the movable and fixed lock parts, respectively, in which the first and second semi-cylindrical parts are located such that the fixed and movable lock parts are relatively movable.

* * * * *